US006998166B2

(12) United States Patent
Prasad

(10) Patent No.: US 6,998,166 B2
(45) Date of Patent: Feb. 14, 2006

(54) POLISHING PAD WITH ORIENTED PORE STRUCTURE

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 10/463,730

(22) Filed: Jun. 17, 2003

(65) Prior Publication Data

US 2004/0258882 A1 Dec. 23, 2004

(51) Int. Cl.

| | |
|---|---|
| ***B32B 27/00*** | (2006.01) |
| ***D06N 7/04*** | (2006.01) |
| ***B24D 11/00*** | (2006.01) |
| ***B24D 3/00*** | (2006.01) |

(52) U.S. Cl. ..... 428/141; 428/423.1; 428/425.1; 428/304.4; 428/338; 428/220; 428/152; 51/296; 51/298; 51/303; 451/527; 451/530

(58) Field of Classification Search ..... 428/147, 428/141, 143, 323, 327, 402, 423.1, 425.1, 428/313.5, 305.5, 332, 338, 220, 152, 163, 428/167, 156, 168, 908.8; 51/296, 298, 302, 51/303; 425/527, 530; 451/527, 530

See application file for complete search history.

(56) References Cited

U.S. PATENT DOCUMENTS

| | | | | |
|---|---|---|---|---|
| 4,271,640 | A * | 6/1981 | Gadbois et al. | 451/527 |
| 4,728,552 | A | 3/1988 | Jensen, Jr. | |
| 4,841,680 | A | 6/1989 | Hoffstein et al. | |
| 4,867,881 | A | 9/1989 | Kinzer | |
| 5,020,283 | A | 6/1991 | Tuttle | |
| 5,257,478 | A | 11/1993 | Hyde et al. | |
| 5,533,923 | A | 7/1996 | Shamouilian et al. | |
| 5,795,218 | A | 8/1998 | Doan et al. | |
| 5,900,164 | A | 5/1999 | Budinger et al. | |
| 6,117,000 | A * | 9/2000 | Anjur et al. | 451/526 |
| 6,290,883 | B1 | 9/2001 | Crevasse et al. | |
| 6,585,574 | B1 * | 7/2003 | Lombardo et al. | 451/285 |

FOREIGN PATENT DOCUMENTS

| | | |
|---|---|---|
| WO | WO 98/28108 | 7/1997 |
| WO | WO 03/012846 | 2/2003 |

* cited by examiner

*Primary Examiner*—Harold Pyon
*Assistant Examiner*—Patricia L. Nordmeyer
(74) *Attorney, Agent, or Firm*—Caryn Borg-Breen; Steven Weseman

(57) ABSTRACT

The invention provides a polishing pad for chemical-mechanical polishing comprising a body, a polishing surface, and a plurality of elongated pores, wherein about 10% or more of the elongated pores have an aspect ratio of about 3:1 or greater and are substantially oriented in a direction that is coplanar with the polishing surface. The invention further provides a method of polishing a substrate.

16 Claims, 1 Drawing Sheet

POLISHING PAD WITH ORIENTED PORE STRUCTURE

FIELD OF THE INVENTION

This invention pertains to a polishing pad for chemical-mechanical polishing.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

Polishing pads used in chemical-mechanical polishing processes are manufactured using both soft and rigid pad materials, which include polymer-impregnated fabrics, microporous films, cellular polymer foams, non-porous polymer sheets, and sintered thermoplastic particles. Non-porous polishing pads are desirable for use in polishing a variety of substrates; however, non-porous polishing pads typically have a polishing surface, which has no intrinsic ability to transport slurry particles (see, e.g., U.S. Pat. Nos. 5,489,233 and 6,203,407). Accordingly, these solid polishing pads must be modified with large and/or small grooves that are cut or molded into the surface of the pad so as to provide channels for the passage of slurry during chemical-mechanical polishing. For example, U.S. Pat. Nos. 6,022,268, 6,217,434, and 6,287,185 disclose solid polishing pads comprising a polishing surface that purportedly has a random surface topography including microaspersities of a dimension of 10 $\mu$m or less that are formed when solidifying the polishing surface and macro defects (or macrotexture) of a dimension of 25 $\mu$m or greater that are formed by cutting.

Porous polishing pads typically have an inherent surface texture that can absorb and/or transport slurry. As such, porous polishing pads often can be used in polishing without the need for forming grooves on the surface of the polishing pad. Porous polishing pads can contain closed cell pores or open cell pores. Typically, the pores are spherical or nearly spherical pores, although some polishing pads comprise elongated pores that are oriented normal to the plane of the polishing pad (see, e.g., U.S. Pat. No. 4,841,680). While porous polishing pads offer many advantages over solid polishing pads in terms of cost and simplicity, porous polishing pads often do not have the most desirable physical properties (e.g., hardness, low compressibility) for certain polishing applications.

Accordingly, there remains a need for polishing pads that can provide effective planarization with satisfactory polishing efficiency and slurry flow across and/or within the polishing pad, that can be produced using low cost production methods, and that require little or no conditioning prior to use. The invention provides such a polishing pad. These and other advantages of the invention, as well as additional inventive features, will be apparent from the description of the invention provided herein.

BRIEF SUMMARY OF THE INVENTION

The invention provides a polishing pad for chemical-mechanical polishing comprising a body, a polishing surface, and a plurality of elongated pores, wherein about 10% or more of the elongated pores have an aspect ratio of about 2:1 or greater and are substantially oriented in a direction that is coplanar with the polishing surface. The invention further provides a method of polishing a substrate comprising (i) providing a substrate to be polished, (ii) contacting the substrate with a polishing system comprising a polishing pad of the invention and a polishing composition, and (iii) abrading at least a portion of the substrate with the polishing system to polish the substrate.

DETAILED DESCRIPTION OF THE INVENTION

Figure 1:
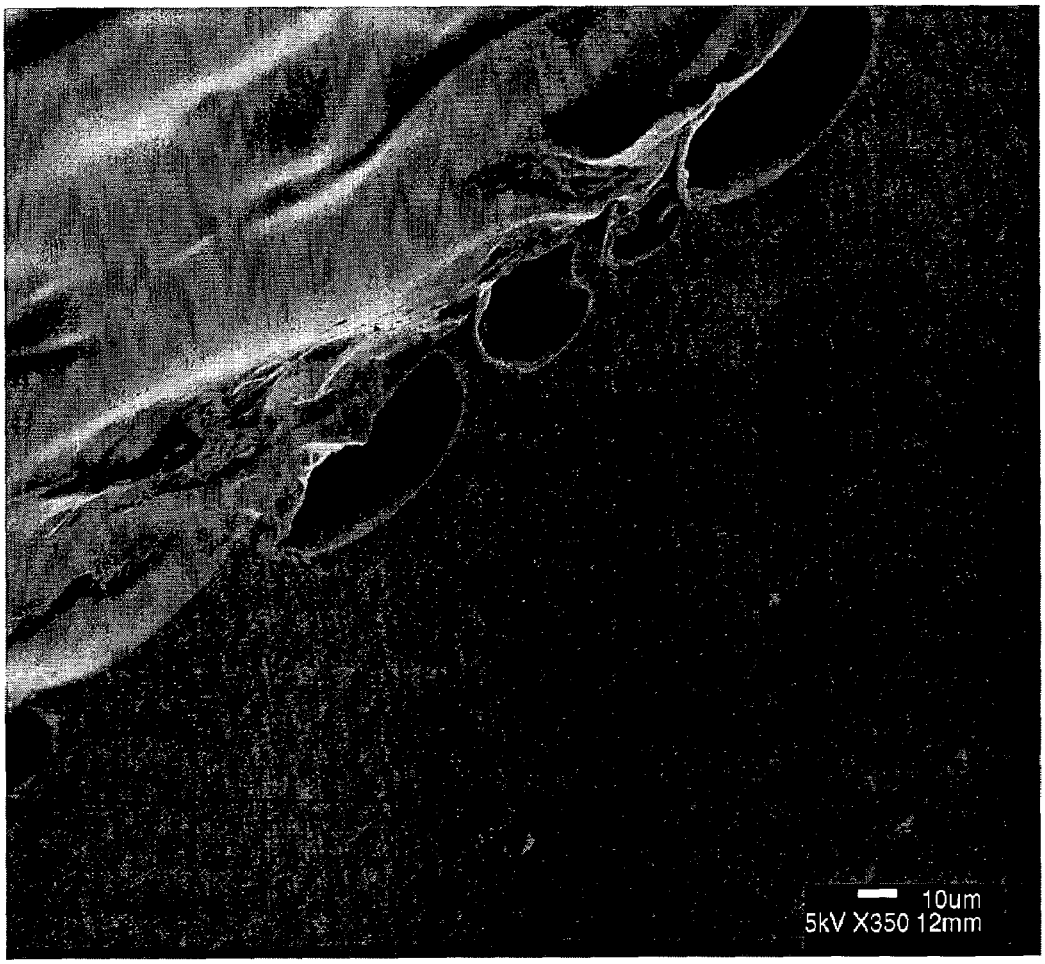
FIG. 1 is a scanning electron micrograph (SEM) image of a portion of a polishing pad of the invention.

The inventive polishing pad is intended for use in chemical-mechanical polishing. The polishing pad comprises a body, a polishing surface, and a plurality of elongated pores having an aspect ratio of about 2:1 or greater. The polishing surface also is referred to herein as the top surface, and the side of the polishing pad opposite the polishing surface is referred to as the bottom surface. About 10% or more of the pores have an aspect ratio of about 2:1 or greater (e.g., about 3:1 or greater, about 5:1 or greater, about 10:1 or greater, or about 20:1 or greater). Desirably, about 20% or more (e.g., about 30% or more, about 40% or more, or about 50% or more) of the pores have an aspect ratio of about 2:1 or greater (e.g., about 3:1 or greater, about 5:1 or greater, about 10:1 or greater, or about 20:1 or greater). Preferably, about 60% or more (e.g., about 70% or more, about 80% or more, or about 90% or more) of the pores have an aspect ratio of about 2:1 or greater (e.g., about 3:1 or greater, about 5:1 or greater, about 10:1 or greater, or about 20:1 or greater).

The elongated pores are substantially oriented in a direction that is coplanar with the polishing surface of the polishing pad. Preferably, about 50% or more (e.g., about 60% or more, or about 70% or more) of the elongated pores are substantially oriented in a direction that is coplanar with the polishing surface. More preferably, about 80% or more (e.g., about 90% or more) of the elongated pores are substantially oriented in a direction that is coplanar with the polishing surface. The elongated pores desirably are oriented in a direction that is within about ±20° (e.g., about ±10°, or about ±5°) of the plane of the polishing surface.

The substantially oriented pores can be present in any portion of the polishing pad. For example, the substantially oriented pores can be present throughout the body of the polishing pad, within an upper portion of the polishing pad (i.e., the portion closer to the polishing surface), within a lower portion of the polishing pad (i.e., the portion farther away from the polishing surface and closer to the opposing bottom surface), or within both an upper and lower portion of the polishing pad (e.g., in combination with a non-porous middle portion of the polishing pad). Typically, the substantially oriented pores are present in about the upper 10% or more (e.g., about the top 20% or more, or about the top 30% or more) of the thickness (i.e., the distance between the polishing surface and the bottom surface of the polishing pad) of the body of the polishing pad.

When the substantially oriented pores are present in the upper portion of the polishing pad, the elongated pores also likely will be present on the polishing surface of the polishing pad. As such, the substantially oriented elongated pores can function as grooves to facilitate the transport of polishing slurry across the polishing surface of the polishing pad. The presence of an inherent groove-like surface texture can reduce or even obviate the need to introduce grooves (e.g., macrogrooves and/or microgrooves) onto the polishing surface by external means. The substantially oriented pores also can be present throughout the thickness of the polishing pad. Accordingly, as the top surfaces of the polishing pad are worn away during polishing, the groove pattern can be continuously renewed.

The polishing pad optionally further comprises a plurality of secondary pores having an aspect ratio of about 2:1 or less that may or may not be substantially oriented in a direction that is coplanar with the polishing surface. Preferably such secondary pores are not substantially oriented in a direction that is coplanar with the polishing surface. Such pores will be spherical or nearly spherical. The secondary pores can be intermingled with the elongated pores or can be in a separate region of the polishing pad from the elongated pores. For example, the elongated pores can be present in the upper about 10% to about 30% of the polishing pad, and a plurality of secondary pores can be present in the lower about 90% to about 70% of the polishing pad. In one embodiment, the elongated pores are present in the upper about 10% of the polishing pad, and the secondary pores are present in the lower about 50% of the polishing pad. Such a polishing pad can function as a multi-layer polishing pad having a porous lower "subpad" layer comprising the secondary pores and a solid upper polishing layer having a groove-like elongated pore structure on the surface.

The polishing pad can comprise, consist essentially of, or consist of any suitable material, typically a polymer resin. The polymer resin can be any suitable polymer resin. Preferably, the polymer resin is a thermoplastic elastomeric polymer resin selected from the group consisting of polyurethanes, cross-linked polyurethanes, polyolefins (e.g., polyethylenes, polypropylenes, cyclic polyolefins), cross-linked polyolefins, polyvinylalcohols, polyvinylacetates, polycarbonates, polyacrylic acids, polymethylmethacrylates, polyacrylamides, nylons, fluoropolymers, polyesters, polyethers, polyarylenes, polystyrenes, polyethyleneterephthalates, polyamides, polyimides, polyaramides, polytetrafluoroethylenes, polyetheretherketones, elastomeric rubbers, polyaromatics, copolymers and block copolymers thereof, and mixtures and blends thereof. More preferably, the polymer resin is a thermoplastic polyurethane resin.

The polishing pad can have any suitable density and any suitable void volume. Typically, the polishing pad has a density that is about 50% or more (e.g., about 60% or more, about 70% or more, or about 80% or more) of the maximum theoretical density of the polymer resin. Accordingly, the polishing pad typically has a void volume of about 50% or less (e.g., about 40% or less, about 30% or less, or about 20% or less). Preferably, the void volume is about 2% or more (e.g., about 5% or more, about 10% or more, or about 15% or more).

The polishing surface of the polishing pad optionally further comprises grooves, channels, and/or perforations, which further facilitate the lateral transport of a polishing composition across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, or XY crosshatch pattern grooves, and can be continuous or non-continuous in connectivity.

The polishing surface of the polishing pad optionally further comprises regions of different density, porosity, hardness, modulus, and/or compressibility. The different regions can have any suitable shape or dimension. Typically, the regions of contrasting density, porosity, hardness, and/or compressibility are formed on the polishing pad by an ex situ process (i.e., after the polishing pad is formed).

The polishing pad optionally further comprises one or more apertures, transparent regions, or translucent regions (e.g., windows as described in U.S. Pat. No. 5,893,796). The inclusion of such apertures or translucent regions is desirable when the polishing pad is to be used in conjunction with an in situ CMP process monitoring technique. The aperture can have any suitable shape and may be used in combination with drainage channels for minimizing or eliminating excess polishing composition on the polishing surface. The translucent region or window can be any suitable window, many of which are known in the art. For example, the translucent region can comprise a glass or polymer-based plug that is inserted in an aperture of the polishing pad or may comprise the same polymeric material used in the remainder of the polishing pad. Typically, the translucent regions have a light transmittance of about 10% or more (e.g., about 20% or more, or about 30% or more) at at least one wavelength in the range of about 200 nm to about 10,000 nm (e.g., about 200 nm to about 1,000 nm, or about 200 nm to about 780 nm).

The polishing pad of the invention can be produced by any suitable method. Typically the polishing pad is produced by extrusion of a polymer resin. In one embodiment, the oriented pore structure is produced by extrusion of polymer granules (or pellets or flakes) that contain trapped gas bubbles (e.g., air bubbles). Such polymer granules can be formed from a polymer cake containing trapped gas bubbles by cutting the polymer cake into small pieces and then pulverizing the pieces into granules. The gas bubble-containing polymer cake can be produced from a polymer reaction mixture (e.g., a polyurethane reaction mixture comprising a diisocyanate hard segment, a polyol soft segment, and a diol chain extender) into which gas is introduced. The gas can be any suitable gas and preferably is air. The amount of gas introduced into the polymer reaction mixture can be any suitable amount. For example, the amount of gas introduced into the reaction mixture can be about 10% to about 50% by volume. During polymer formation, the viscosity of the reaction mixture increases such that the gas becomes trapped in the polymer mixture and resulting polymer cake. Preferably, the reaction mixture is stirred at a high rate during polymer formation to optimize the entrapment of the gas. The polymer cake desirably comprises about 10% to about 50% gas bubbles by volume. Unlike typical extrusion processes, the gas bubble-containing pellets or granules preferably are not extruded into polymer pellets before being extruded into a polymer sheet (as is typically done in extrusion processes) since such a preliminary extrusion step could result in the release of the trapped gas bubbles from the polymer granules.

The polymer granules formed from the gas bubble-containing polymer cake can be converted into a polymer sheet containing elongated oriented pores by extruding the polymer granules under carefully controlled extrusion conditions. The extrusion parameters such as temperature and pressure should be carefully controlled to prevent premature release of the trapped gas bubbles. The particular extrusion conditions will of course depend at least in part on the type of polymer resin being extruded and the degree of pore orientation that is desired.

In another embodiment, the polishing pad of the invention is produced by forcing gas into a polymer sheet having an oriented polymer structure. A polymer sheet having an oriented polymer structure can be produced by extrusion of a high molecular weight polymer that has a long relaxation time. Once the polymer sheet is produced, the polymer sheet can be subjected to a pressurized gas injection process, which foams the polymer sheet. The pressurized gas injection process involves the use of high temperatures and pressures to force a supercritical fluid gas into a polymer sheet comprising an amorphous polymer resin. The polymer resin can be any of the polymer resins described above. The extruded polymer sheet is placed at room temperature into a pressure vessel. A supercritical gas (e.g., $N_2$ or $CO_2$) is added to the vessel, and the vessel is pressurized to a level sufficient to force an appropriate amount of the gas into the free volume of the polymer sheet. The amount of gas dissolved in the polymer is directly proportional to the applied pressure according to Henry's law. Increasing the temperature of the polymer sheet increases the rate of diffusion of the gas into the polymer, but also decreases the amount of gas that can dissolve in the polymer sheet. Once the gas has sufficiently saturated the polymer, the sheet is removed from the pressurized vessel. If desired, the polymer sheet can be quickly heated to a softened or molten state if necessary to promote cell nucleation and growth. U.S. Pat. Nos. 5,182,307 and 5,684,055 describe these and additional features of the pressurized gas injection process.

In yet another embodiment, the polishing pad of the invention can be first extruded from polymer granules containing trapped gas to form a polymer sheet having oriented elongated pores, and then subjected to the foaming process described above to produce a polishing pad having a combination of elongated oriented pores and secondary pores having an aspect ratio of about 2:1 or less.

The selection of the polymer resin will depend, in part, on the rheology of the polymer resin. Rheology is the flow behavior of a polymer melt. For Newtonian fluids, the viscosity is a constant defined by the ratio between the shear stress (i.e., tangential stress, $\sigma$) and the shear rate (i.e., velocity gradient, $d\gamma/dt$). However, for non-Newtonian fluids, shear rate thickening (dilatent) or shear rate thinning (pseudo-plastic) may occur. In shear rate thinning cases, the viscosity decreases with increasing shear rate. It is this property that allows a polymer resin to be used in melt fabrication (e.g., extrusion, injection molding) processes. In order to identify the critical region of shear rate thinning, the rheology of the polymer resins must be determined. The rheology can be determined by a capillary technique in which the molten polymer resin is forced under a fixed pressure through a capillary of a particular length. By plotting the apparent shear rate versus viscosity at different temperatures, the relationship between the viscosity and temperature can be determined. The Rheology Processing Index (RPI) is a parameter that identifies the critical range of the polymer resin. The RPI is the ratio of the viscosity at a reference temperature to the viscosity after a change in temperature equal to 20° C. for a fixed shear rate. When the polymer resin is thermoplastic polyurethane, the RPI preferably is about 2 to about 10 (e.g., about 3 to about 8) when measured at a shear rate of about 150 1/s and a temperature of about 205° C. Preferably, the polymer resin has a viscosity of about 700 Pa-s or greater (e.g., about 1000 Pa-s or greater, about 1500 Pa-s or greater, about 2000 Pa-s or greater, or about 2500 Pa-s or greater) at a shear rate of about 18.6 $s^{-1}$ and a temperature of about 210° C.

Another polymer viscosity measurement is the Melt Flow Index (MFI) which records the amount of molten polymer (in grams) that is extruded from a capillary at a given temperature and pressure over a fixed amount of time. For example, when the polymer resin is thermoplastic polyurethane or polyurethane copolymer (e.g., a polycarbonate silicone-based copolymer, a polyurethane fluorine-based copolymer, or a polyurethane siloxane-segmented copolymer), the MFI preferably is about 40 or less (e.g., about 30 or less, or about 20 or less) over 10 minutes at a temperature of 210° C. and a load of 2160 g. When the polymer resin is a thermoplastic elastomeric polyolefin or a polyolefin copolymer (e.g., a copolymer comprising an ethylene $\alpha$-olefin such as elastomeric or normal ethylene-propylene, ethlene-hexene, ethylene-octene, and the like, an elastomeric ethylene copolymer made from metallocene based catalysts, or a polypropylene-styrene copolymer), the MFI preferably is about 5 or less (e.g., about 4 or less) over 10 minutes at a temperature of 210° C. and a load of 2160 g. When the polymer resin is a nylon or polycarbonate, the MFI preferably is about 8 or less (e.g., about 5 or less) over 10 minutes at a temperature of 210° C. and a load of 2160 g.

The rheology of the polymer resin can depend on the molecular weight, polydispersity index (PDI), the degree of long-chain branching or cross-linking, glass transition temperature ($T_g$), and melt temperature ($T_m$) of the polymer resin. When the polymer resin is thermoplastic polyurethane or polyurethane copolymer (such as the copolymers described above), the weight average molecular weight ($M_w$) is typically about 100,000 g/mol or more (e.g., about 200,000 g/mol or more, or about 300,000 g/mol or more), with a PDI of about 1.1 to about 6, preferably about 2 to about 4. Typically, the thermoplastic polyurethane has a glass transition temperature of about 20° C. to about 110° C. and a melt transition temperature of about 120° C. to about 250° C. When the polymer resin is an elastomeric polyolefin or a polyolefin copolymer (such as the copolymers described above), the weight average molecular weight ($M_w$) typically is about 100,000 g/mol to about 400,000 g/mol, preferably about 150,000 g/mol to about 300,000 g/mol, with a PDI of about 1.1 to about 12, preferably about 2 to about 10. When the polymer resin is nylon or polycarbonate, the weight average molecular weight ($M_w$) typically is about 50,000 g/mol to about 150,000 g/mol, preferably about 70,000 g/mol to about 100,000 g/mol, with a PDI of about 1.1 to about 5, preferably about 2 to about 4.

The polymer resin selected for the porous foam preferably has certain mechanical properties. For example, when the polymer resin is a thermoplastic polyurethane, the Flexural Modulus (ASTM D790) preferably is about 500 MPa to about 1500 MPa, the average % compressibility is about 7 or less, the average % rebound is about 35 or greater, and the Shore D hardness (ASTM D2240-95) is about 40 to about 90 (e.g., about 50 to about 80). Preferably, the top surface of the polishing pad has a surface roughness of about 1 to about 3 micron Ra.

The polishing pad is particularly suited for use in conjunction with a chemical-mechanical polishing ("CMP") apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a substrate to be polished by contacting and moving relative to the surface of the polishing pad intended to contact a substrate to be polished. The polishing of the substrate takes place by the substrate being placed in contact with the polishing pad and then the polishing pad moving relative to the substrate, typically with a polishing composition therebetween, so as to abrade at least a portion of the substrate to polish the substrate. The CMP apparatus can be any suitable CMP apparatus, many of which are known in the art. The polishing pad of the invention also can be used with linear polishing tools.

The polishing pad can be used alone or optionally can be mated to a polishing subpad. The subpad can be any suitable subpad. Suitable subpads include polyurethane foam subpads (e.g., Poron® foam subpads commercially available from Rogers Corporation), impregnated felt subpads, microporous polyurethane subpads, or sintered urethane subpads. The subpad typically is softer than the polishing pad of the invention and therefore is more compressible and has a lower Shore hardness value than the polishing pad of the invention. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. The subpad can be affixed to the polishing layer by any suitable means. For example, the polishing layer and subpad can be affixed through adhesives or can be attached via welding or similar technique. Typically, an intermediate backing layer such as a polyethylene-terephthalate film is disposed between the polishing pad and the subpad.

The polishing pad of the invention is suitable for use in a method of polishing many types of substrates (e.g., wafers) and substrate materials. The method comprises (i) providing a substrate to be polished, (ii) contacting the substrate with a polishing system comprising a polishing pad of the invention and a polishing composition, and (iii) abrading at least a portion of the substrate with the polishing system to polish the substrate. Suitable substrates include memory storage devices, glass substrates, memory or rigid disks, metals (e.g., noble metals), magnetic heads, inter-layer dielectric (ILD) layers, polymeric films, low and high dielectric constant films, ferroelectrics, micro-electro-mechanical systems (MEMS), semiconductor wafers, field emission displays, and other microelectronic substrates, especially microelectronic substrates comprising insulating layers (e.g., metal oxide, silicon nitride, or low dielectric materials) and/or metal-containing layers (e.g., copper, tantalum, tungsten, aluminum, nickel, titanium, platinum, ruthenium, rhodium, iridium, alloys thereof, and mixtures thereof). The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material. Suitable metal oxide insulating layers include, for example, alumina, silica, titania, ceria, zirconia, germania, magnesia, and combinations thereof. In addition, the substrate can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The substrate also can comprise, consist essentially of, or consist of any suitable semiconductor base material. Suitable semiconductor base materials include single-crystal silicon, poly-crystalline silicon, amorphous silicon, silicon-on-insulator, and gallium arsenide.

The polishing composition comprises a liquid carrier (e.g., water) and optionally one or more additives selected from the group consisting of abrasives (e.g., alumina, silica, titania, ceria, zirconia, germania, magnesia, and combinations thereof), oxidizers (e.g., hydrogen peroxide and ammonium persulfate), corrosion inhibitors (e.g., benzotriazole), film-forming agents (e.g., polyacrylic acid and polystyrene-sulfonic acid), complexing agents (e.g., mono-, di-, and poly-carboxylic acids, phosphonic acids, and sulfonic acids), pH adjustors (e.g., hydrochloric acid, sulfuric acid, phosphoric acid, sodium hydroxide, potassium hydroxide, and ammonium hydroxide), buffering agents (e.g., phosphate buffers, acetate buffers, and sulfate buffers), surfactants (e.g., nonionic surfactants), salts thereof, and combinations thereof. The selection of the components of the polishing composition depends in part on the type of substrate being polished.

EXAMPLE

This example further illustrates the invention but, of course, should not be construed as in any way limiting its scope. In particular, this example illustrates a method of producing a polishing pad of the invention containing oriented pores.

Thermoplastic polyurethane was prepared by a batch process involving reaction of methyldiphenyldiisocyanate with a polyol and 1,4-butanediol. During the polymer synthesis, air (35% by volume) was introduced into the polymer reaction mixture. As the viscosity of the polymer reaction mixture increased due to formation of the polymer, the air (25% by volume) became trapped in the polymer cake. The polymer cake was cut into small pieces and was converted into granules (or flakes) using a hammer. The physical properties of the thermoplastic polyurethane granules are given in Table 1, where DMA, DSC, and GPC refer to Dynamic Mechanical Analysis, Differential Scanning Calorimetry, and Gel Permeation Chromatography, respectively.

TABLE 1

| | |
|---|---|
| Shore D Hardness | 75 D |
| Density | 0.86 g/cm$^3$ |
| Peak $T_g$ (DMA) | 56° C. |
| $T_m$ range (DSC) | 120–180° C. |
| Melt Flow Index at 210° C. | 1.6 g/10 min |
| $M_w$ (GPC) | 175,000 g/mol |
| $M_n$ (GPC) | 65,000 g/mol |
| $M_w/M_n$ (PDI) | 2.7 |
| RPI @ shear rates 150 l/s, ref. temp. 205° C. | 2.8 |
| Flexural Modulus | 1241 MPa |
| Young's Modulus at 25° C. | 814 MPa |
| Ultimate Tensile Strength | 53 MPa |
| Ultimate Elongation | 355% |

The thermoplastic polyurethane granules were then placed into an extruder and extruded under the conditions described in Table 2.

TABLE 2

| | |
|---|---|
| Zone 1 Temperature | 175° C. |
| Zone 2 Temperature | 191° C. |
| Zone 3 Temperature | 196° C. |
| Zone 4 Temperature | 204° C. |
| Zone 5 Temperature | 191° C. |
| Die 1 Temperature | 193° C. |
| Die 2 Temperature | 194° C. |
| Melt Temperature | 213° C. |
| Die Pressure | 7.72 MPa |
| Screw Speed | 20 rpm |

The physical properties of the resulting extruded polymer sheet are given in Table 3. An SEM image of the polymer sheet showing the oriented pores is shown in FIG. 1.

TABLE 3

| | |
|---|---|
| Thickness | ~1320 $\mu$m |
| Density | 1.16 g/cm$^3$ |
| Shore A Hardness | 95.6 |
| Peak Stress | 39 MPa |
| Average Pore Size | 55 $\mu$m × 25 $\mu$m |
| % Compressibility at 0.031 MPa | 2.9 ± 1.8% |
| % Rebound at 0.031 MPa | 44.4 ± 4% |
| Flexural Modulus | 1241 MPa |
| Avg. Surface Roughness | 1.8 ± 0.3 $\mu$m Ra |
| Air Permeability | none |
| $T_g$ (DMA) | 55° C. |
| $T_m$ range (DSC) | 120–180° C. |
| Taber Wear | 44 mg/1000 cycle |
| Ultimate Tensile Strength | 53 MPa |
| Ultimate Elongation | 355 ± 35% |

This example demonstrates that polishing pads comprising substantially oriented elongated pores can be produced by extrusion of polymer granules comprising trapped gas bubbles under mild conditions.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad for chemical-mechanical polishing comprising a body, a polishing surface, and a plurality of pores, wherein about 10% or more of the pores are elongated pores having an aspect ratio of about 3:1 or greater that are substantially oriented in a direction that is coplanar with the polishing surface, and wherein any remaining pores are secondary pores having an aspect ratio of about 2:1 or less that are not substantially oriented in a direction that is coplanar with the polishing surface.

2. The polishing pad of claim 1, wherein about 10% or more of the pores are elongated pores having an aspect ratio of about 5:1 or greater.

3. The polishing pad of claim 1, wherein about 50% or more of the pores are elongated pores having an aspect ratio of about 3:1 or greater.

4. The polishing pad of claim 1, wherein the body of the polishing pad has a thickness defined by the distance between the polishing surface and a bottom surface of the polishing pad, and wherein the elongated pores are present in the upper about 20% or more of the thickness of the body of the polishing pad.

5. The polishing pad of claim 1, wherein the polishing pad further comprises a polymer resin.

6. The polishing pad of claim 5, wherein the polymer resin is a thermoplastic elastomeric polymer resin selected from the group consisting of polyurethanes, polyvinylalcohols, polyvinylacetates, polycarbonates, polyacrylic acids, polyacrylamides, polyolefins, polyethylenes, polypropylenes, nylons, fluorocarbons, polyesters, polyethers, polyamides, polyimides, polytetrafluoroethylenes, polyethcretherketones, copolymers thereof, and mixtures thereof.

7. The polishing pad of claim 6, wherein the thermoplastic elastomeric polymer resin is a polyurethane resin.

8. The polishing pad of claim 5, wherein the polymer resin has a viscosity of about 700 Pa-s or greater at a shear rate of about 18.6 s−1 and a temperature of about 210° C.

9. The polishing pad of claim 5, wherein the polishing pad has a density that is about 70% or more of the maximum theoretical density of the polymer resin.

10. The polishing pad of claim 1, wherein the polishing pad has a void volume of about 2% or more.

11. The polishing pad of claim 10, wherein the polishing pad has a void volume of about 5% or more.

12. The polishing pad of claim 11, wherein the polishing pad has a void volume of about 30% or less.

13. The polishing pad of claim 1, wherein the polishing pad has a void volume of about 50% or less.

14. The polishing pad of claim 1, wherein the polishing pad is a polishing layer and is mated to a polishing subpad.

15. The polishing pad of claim 1, further comprising one or more regions having a light transmittance of about 10% or more at a wavelength of about 200 nm to about 10,000 nm.

16. The polishing pad of claim 1, wherein the polishing surface has a surface roughness of about 1 to about 3 micron Ra.

* * * * *